US008106864B2

(12) United States Patent
Moon et al.

(10) Patent No.: US 8,106,864 B2
(45) Date of Patent: Jan. 31, 2012

(54) LIQUID CRYSTAL DISPLAY DEVICE

(75) Inventors: Kyo Ho Moon, Daegu (KR); Chul Gu Lee, Gyeonggi-do (KR); Hoon Choi, Incheon (KR); Yong Soo Cho, Daegu (KR); Sang Kug Han, Gwangju (KR)

(73) Assignee: LG Display Co., Ltd., Seoul (KR)

( * ) Notice: Subject to any disclaimer, the term of this patent is extended or adjusted under 35 U.S.C. 154(b) by 323 days.

(21) Appl. No.: 12/556,186

(22) Filed: Sep. 9, 2009

(65) Prior Publication Data

US 2010/0231492 A1 Sep. 16, 2010

(30) Foreign Application Priority Data

Oct. 10, 2008 (KR) ..... 10-2008-0099404

(51) Int. Cl.
*G09G 3/36* (2006.01)

(52) U.S. Cl. ..... 345/87; 345/100

(58) Field of Classification Search ..... None
See application file for complete search history.

(56) References Cited

U.S. PATENT DOCUMENTS

2006/0221040 A1 * 10/2006 Pak et al. ..... 345/100
2008/0191994 A1 * 8/2008 Chiang et al. ..... 345/100

* cited by examiner

*Primary Examiner* — Paul Huber
(74) *Attorney, Agent, or Firm* — Morgan, Lewis & Bockius LLP

(57) ABSTRACT

An LCD device is disclosed.
The LCD device includes dual gate transistors provided to an output portion for outputting a gate voltage. As such, the charge/discharge time of the output portion is reduced so the response time of liquid crystal is improved.

6 Claims, 7 Drawing Sheets

LIQUID CRYSTAL DISPLAY DEVICE

CROSS-REFERENCE TO RELATED APPLICATION

This application claims priority under 35 U.S.C. 119 to Korean Patent Application No. 10-2008-0099404, filed on Oct. 10, 2008, which is hereby incorporated by reference in its entirety.

BACKGROUND

1. Field of the Disclosure

This disclosure relates to a liquid crystal display device capable of improving the response time of liquid crystal.

2. Description of the Related Art

Nowadays, image display devices driving pixels arranged in an active matrix shape have been widely researched. The image display devices include liquid crystal display (LCD) devices, organic electro-luminescent display (OLED) devices, and so on.

More specifically, the LCD device applies data signals, corresponding to image information, to the pixels arranged in the active matrix shape and controls the transmissivity of the liquid crystal layer so that the desired image is displayed. To this end, the LCD device includes a liquid crystal panel with the pixels arranged in an active matrix shape, and a drive circuitry driving the liquid crystal panel.

In the liquid crystal panel, gate lines and data lines are arranged to cross each other and pixel regions are defined by the gate lines and the data lines crossing. Each of the pixel regions includes a thin film transistor TFT and a pixel electrode connected to it. The thin film transistor TFT includes a gate electrode connected to the respective gate line, a source electrode connected to the respective data line, and a drain electrode connected to the respective pixel electrode.

The drive circuitry includes a gate driver sequentially applying scan signals to the gate lines and a data driver applying data signals to the data lines. As the gate driver sequentially applies the scan signals to the gate lines, the pixels on the liquid crystal panel are selected in the line unit. Whenever the gate lines are sequentially selected one by one, the data driver applies the data signals to the data lines. As such, the transmissivity of the liquid crystal layer is controlled by an electric field which is induced between the pixel electrode and a common electrode and corresponds to the data signal applied to each pixel. Accordingly, the LCD device displays an image.

In order to lower the manufacturing cost, an LCD device of an internal driver type has recently been developed which includes the gate driver and the data driver provided on the liquid crystal panel. In the LCD device of an internal driver type, the gate driver is simultaneously manufactured with the thin film transistors when the thin film transistors are formed on the liquid crystal panel. Meanwhile, the data driver may or may not be provided on the liquid crystal panel.

As the LCD device becomes larger in size, the gate lines lengthen by the increment of screen size so that line resistances increase. This results in the response time of the liquid crystal becoming slower due to the lowered changing rate of the thin film transistor.

In order to improve the response time of the liquid crystal, the channel region of the thin film transistor can be expanded. However, in the LCD device of an internal type, it is difficult to improve the charging rate of the liquid crystal due to an area limitation.

BRIEF SUMMARY

Accordingly, the present embodiments are directed to an LCD device that substantially obviates one or more of problems due to the limitations and disadvantages of the related art.

An object of the present embodiment is to provide an LCD device that is adapted to improve the response time of liquid crystal by reducing the charge/discharge time of the thin film transistor.

Additional features and advantages of the embodiments will be set forth in the description which follows, and in part will be apparent from the description, or may be learned by practice of the embodiments. The advantages of the embodiments will be realized and attained by the structure particularly pointed out in the written description and claims hereof as well as the appended drawings.

According to a general aspect of the present embodiment, an LCD device includes: a display panel displaying an image and including a plurality of gate lines and a plurality of data lines arranged thereon; a data driver supplying the data lines of the display panel with data signals corresponding to the image; and a gate driver formed on the display panel and having a plurality of shift registers sequentially shifting a start pulse to be applied to the gate lines. Each of the shift registers includes an output portion with first and second dual gate transistors, and a control portion controlling the voltages on the first and second nodes. Wherein the first dual gate transistor includes: first and second gate electrodes responsive to a voltage on a first node, a source electrode receiving a clock signal, and a drain electrode connected to the respective gate line applying the clock signal from the source electrode to the respective gate line according to the voltage on the first node, and the second dual gate transistor includes: first and second gate electrodes responsive to a voltage on a second node, a drain electrode receiving a first source voltage, and a source electrode applying the first source voltage on the drain electrode to the respective gate line according to the voltage on the second node.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims. Nothing in this section should be taken as a limitation on those claims. Further aspects and advantages are discussed below in conjunction with the embodiments. It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the embodiments and are incorporated in and constitute a part of this application, illustrate embodiment(s) of the invention and together with the description serve to explain the disclosure. In the drawings.

DETAILED DESCRIPTION

Figure 1:
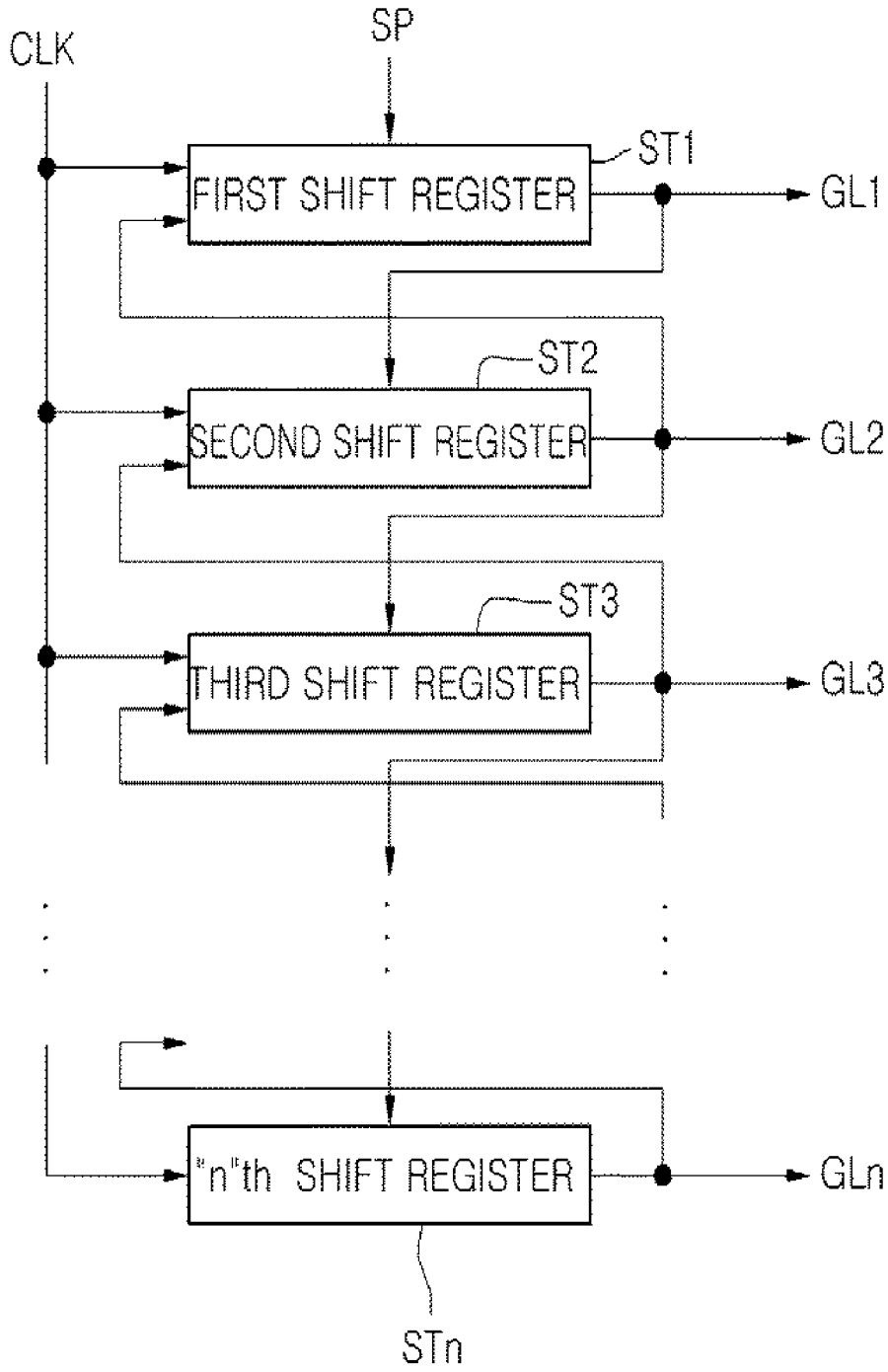
FIG. 1 is a view schematically showing a gate driver according to an embodiment of the present disclosure.

Reference will now be made in detail to the embodiments of the present disclosure, examples of which are illustrated in the accompanying drawings. These embodiments introduced hereinafter are provided as examples in order to convey their spirits to the ordinary skilled person in the art. Therefore, these embodiments might be embodied in a different shape, so are not limited to these embodiments described here. Also, the size and thickness of the device might be expressed to be exaggerated for the sake of convenience in the drawings. Wherever possible, the same reference numbers will be used throughout this disclosure including the drawings to refer to the same or like parts.

FIG. 1 is a view schematically showing a gate driver according to an embodiment of the present disclosure.

The gate driver according to the embodiment of the present invention includes a plurality of shift registers T1~STn opposite to a plurality of gate lines GL1~GLn, as shown in FIG. 1. Each of the shift registers ST1~STn is connected to an input line for a clock signal CLK, the output terminal of a shift register ST positioned at the next stage thereof, and the output terminal of another shift register ST positioned at the previous stage thereof. The first shift register ST1 is connected to the input line for the clock signal CLK, the output terminal of a second shift register ST2, and an input line for a start pulse SP.

Figure 2:
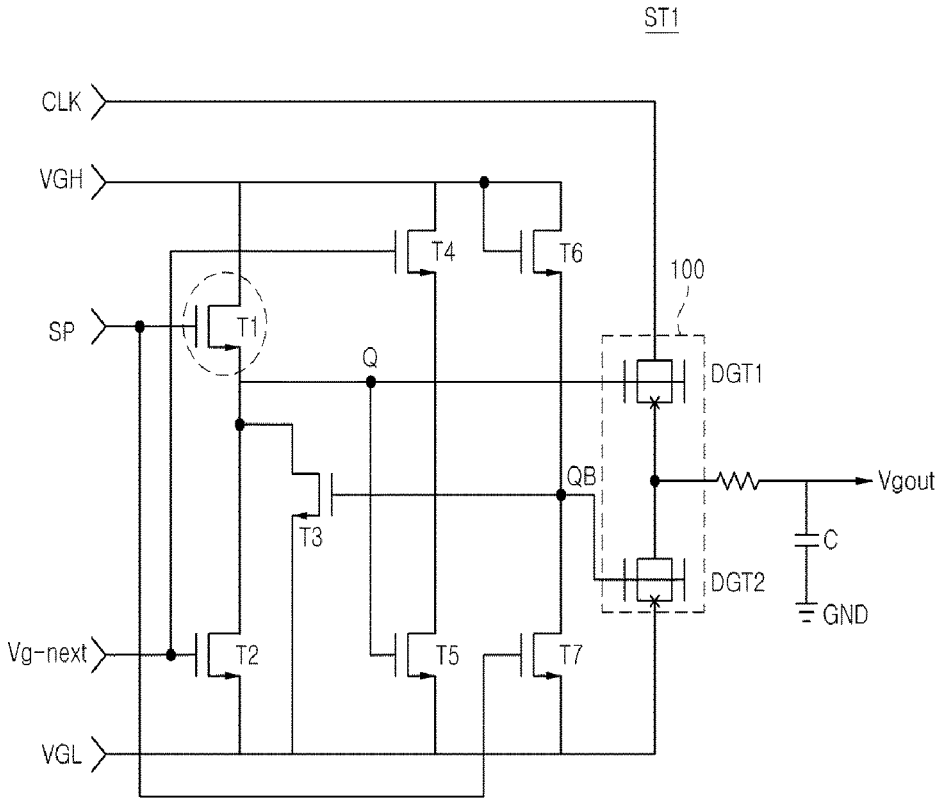
FIG. 2 is a view showing the detailed circuit configuration of the first shift register in FIG. 1.

FIG. 2 is a view showing the detailed circuit configuration of the first shift register in FIG. 1.

The first shift register ST1 inputs the start pulse SP, the clock signal CLK, and an output signal from the second shift register ST2 corresponding to the next stage thereof. A gate high voltage VGH and a gate low voltage VGL are applied to the first shift register ST1. Also, the first shift register ST1 consists of a control portion including first to seventh transistors T1~T7 and an output portion including first and second dual gate transistors DGT1 and DGT2.

The control portion of the first shift register ST1 includes: the first transistor T1 which responds to the start pulse SP and is connected between the input line for the gate high voltage VGH and a first node Q; the second transistor T2 which responds to an output signal of the second shift register ST2 and is connected between the first node Q and the input line for gate low voltage VGL; and a third transistor T3 which responds to a voltage from a second node QB and is connected between a drain electrode of the first transistor T1 and the input line for the gate low voltage VGL.

The control portion of the first shift register ST1 further includes: the fourth transistor T4 which responds to the output signal of the second shift register ST2 and is connected between the input line for the gate high voltage VGH and a source electrode of the fifth transistor T5; and the fifth transistor T5 which responds to the voltage on the first node Q and is connected between a drain electrode of the fourth transistor T4 and the input line for the gate low voltage VGL.

Furthermore, the control portion of the first shift register ST1 includes: the sixth transistor T6 which responds to the gate high voltage VGH and is connected between the input line for the gate high voltage VGH and the second node QB; and the seventh transistor T7 which responds to the start pulse SP and is connected between the second node QB and the input line for the gate low voltage VGL.

The output portion 100 of the first shift register ST1 includes: the first dual gate transistor DGT1 which selectively applies the clock signal CLK to the first gate line GL1 opposite to the first shift register ST1 according to the voltage on the first node Q; and the second dual gate transistor DGT2 which selectively discharges the voltage on the first gate line GL1 according to the voltage on the second node QB.

The first dual gate transistor DGT1 includes a bottom gate electrode connected to the first node Q, a source electrode connected to the input line for the clock signal CLK, a drain electrode connected to the first gate line GL1, and a top gate electrode connected to the first node Q together with the bottom gate electrode.

The second dual gate transistor DGT2 includes a bottom gate electrode connected to the second node QB, a source electrode connected to the first gate line GL1, a drain electrode connected to the input line GL1 for the gate low voltage VGL, and a top gate electrode connected to the second node QB together with the bottom gate electrode.

Figure 3:
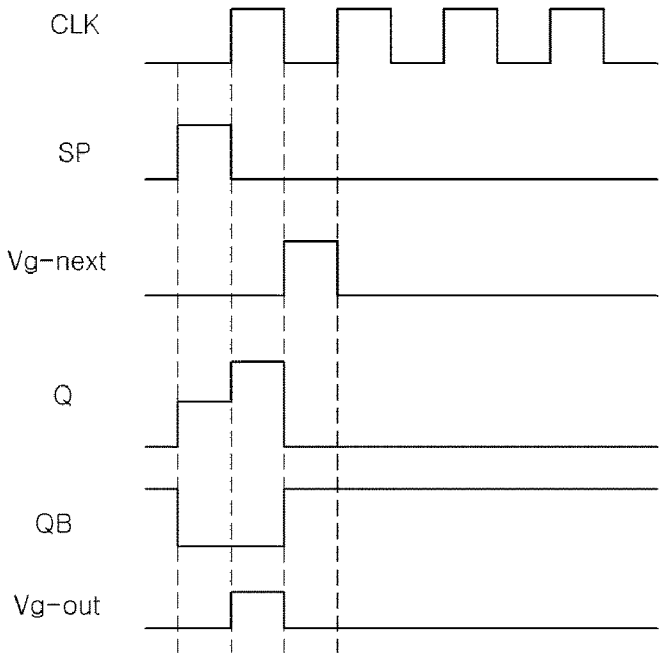
FIG. 3 is a waveform diagram showing drive signals applied to the first shift register of FIG. 2.

FIG. 3 is a waveform diagram showing drive signals applied to the first shift register of FIG. 2.

As shown in FIGS. 2 and 3, the first shift register ST1 inputs the clock signal CLK of a fixed period which includes low and high state pulses. The start pulse SP has a falling time synchronized with the rising time of the first high state pulse of the clock signal CLK, and the output signal Vg-next of the second shift register ST2 has a high state pulse synchronized with a first low state pulse of the clock signal CLK.

In the first interval during which the start pulse SP of the high state is applied to the first shift register ST1, the first transistor T1 of the first shift register ST1 is turned-on so that the gate high voltage VGH is applied to the first node Q via the source and drain electrodes of the first transistor T1. At the same time, the seventh transistor T7 is also turned-on, thereby allowing the gate low voltage VGL on the gate low voltage input line VGL to be applied to the second node QB.

During the second interval, the start pulse SP goes to a low state and the clock signal CLK of a high state is applied to the first shift register ST1. Then, the first dual gate transistor DGT1 is turned-on.

More specifically, the first dual gate transistor DGT1 is turned-on by means of the charging of the gate high voltage VGH in the first node Q during the second interval. When the clock signal CLK goes to a high state, a bootstrapping phenomenon occurs by means of an internal capacitor Cgs, formed between the gate electrodes and source electrode of the first dual gate transistor DGT1, so that the voltage on the first node Q rises about two times that of the gate high voltage VGH and ensures a high state. As such, the first dual gate transistor DGT1 is sufficiently turned-on and applies the clock signal CLK of the high state to the first gate line GL1 as an output signal Vgout of the first shift register ST1.

In this manner, the output signal Vgout corresponding to the gate high voltage VGH is applied to the first gate line GL1 as the first dual gate transistor DGT1 is sufficiently turned-on.

Sequentially, the first shift register ST1 inputs the clock signal CLK of the low state and receives the output signal Vg-next of the high state from the second shift register ST2 next to the first shift register ST1, during a third interval. At this time the sixth transistor T6 is turned-on so that the gate high voltage VGH is charged in the second node QB. As such, the second dual gate transistor DGT2 responds to the voltage on the second node QB is turned-on, thereby enabling the gate low voltage VGL to be applied to the first gate line GL1, which is connected to the first shift register ST1, via the second dual gate transistor DGT2. In other words, the first gate line GL1 charges the gate low voltage VGL during the third interval.

On the other hand, as the gate high voltage VGH is charged in the second node QB, the third transistor T3 connected to the second node QB is turned-on. In accordance therewith, the voltage charged in the first node Q changes into the gate low voltage VGL from the gate low voltage input line VGL.

In this way, since the gate low voltage VGL and the gate high voltage VGH are applied to the first and second nodes Q and QB of the first shift register ST1, respectively, the first gate line GL1 is charged by the gate low voltage VGL passing through the second dual gate transistor DGT2, during the third interval.

As described above, the first and second dual gate transistors DGT1 and DGT2 include the bottom and top gate electrodes and have a fast charging/discharging time in comparison with the related art transistor having only the bottom gate electrode.

Figure 4:
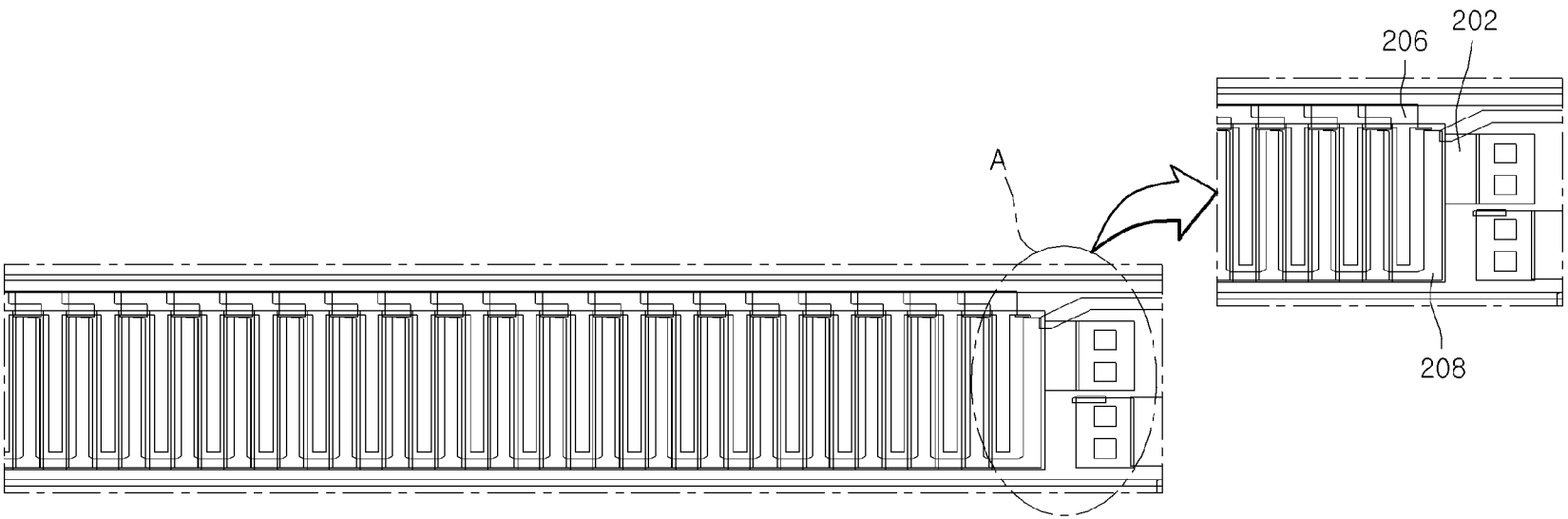
FIG. 4 is a view schematically showing the first transistor included in the first shift register of FIG. 2.

FIG. 4 is a view schematically showing the first transistor included in the first shift register of FIG. 2.

Referring to FIGS. 2 and 4, the first transistor T1 includes: a gate electrode 202; a gate insulating film (not shown) formed to cover the gate electrode 202; a semiconductor layer (not shown) formed opposite the gate electrode 202 on the gate insulating film; and a plurality of source and drain electrodes 206 and 208 facing each other in the center of the channel portions of the semiconductor layer. The plural source electrodes 206 are electrically connected to one another and the plural drain electrode 208 are electrically connected to one another as well.

Figure 5:
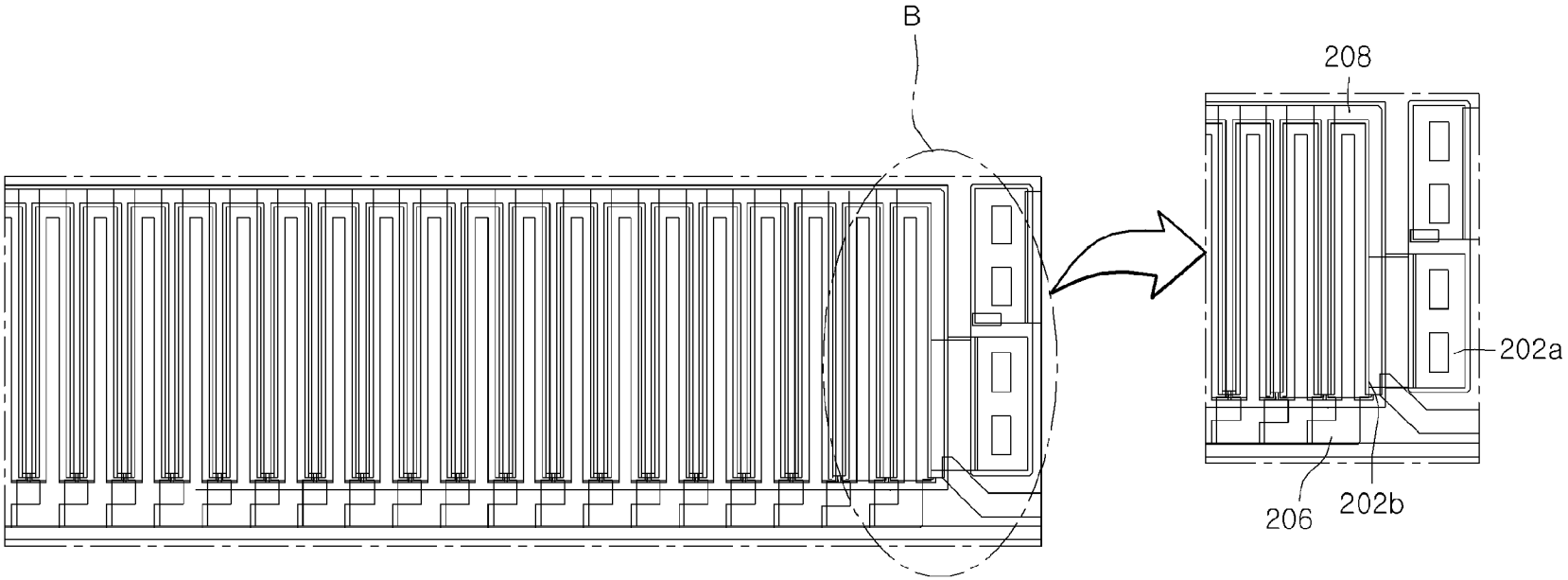
FIG. 5 is a view schematically showing the first dual gate transistor included in the first shift register of FIG. 2.

FIG. 5 a view schematically showing the first dual gate transistor included in the first shift register of FIG. 2;

As shown in FIGS. 2 and 5, the first dual gate transistor DGT1 includes: a bottom gate electrode 202*a*; a gate insulating film (not shown) formed to cover the bottom gate electrode 202*a*; a semiconductor layer (not shown) formed opposite the bottom gate electrode 202*a* on the gate insulating film; a plurality of source and drain electrodes 206 and 208, on the semiconductor layer, facing each other in the center of the channel portions of the semiconductor layer; a passivation (or protection) layer (not shown) formed to cover the source and drain electrodes 206 and 208; and a top gate electrode 202*b* formed on the passivation layer and electrically connected to the bottom gate electrode 202*a* through a contact hole. The plural source electrodes 206 are electrically connected to one another and the plural drain electrodes 208 are electrically connected to one another as well.

The channel portions of the first transistor T1 shown in FIG. 4 are larger than the channel portions of the first dual gate transistor DGT1 shown in FIG. 5. Also, the number of the source and drain electrodes 206 and 208 in the first transistor T1 is greater than the number of the source and drain electrodes 206 and 208 in the first dual gate transistor DGT1. As a result, the capacity of the first transistor T1 is greater than that of the first dual gate transistor DGT1.

Figure 6:
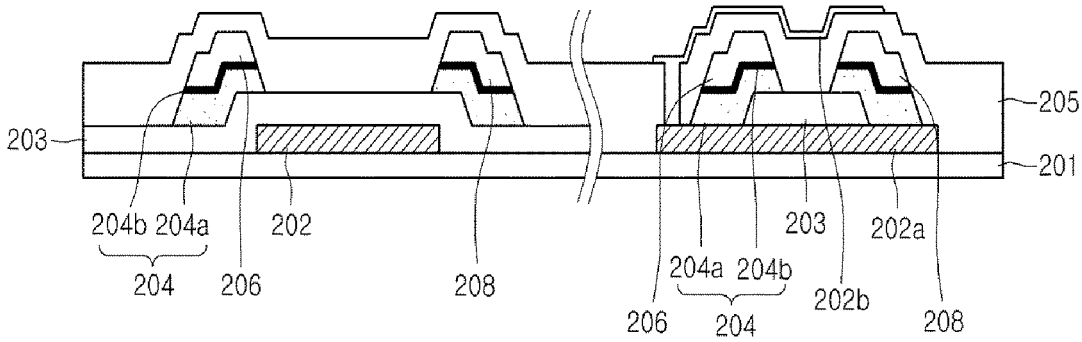
FIG. 6 is a view showing the cross-sectional surfaces of the first transistor of FIG. 4 and the first dual gate transistor of FIG. 5.

FIG. 6 is a view showing a cross-section of the surfaces of the first transistor of FIG. 4 and the first dual gate transistor of FIG. 5.

As shown in FIG. 6, the first transistor T1 includes: the gate electrode 202 formed on a substrate 201; the gate insulating film 203 formed on the substrate 201 having the gate electrode 202; the semiconductor layer 204 formed on the substrate 201, opposite to the gate electrode 202, having the gate insulating film 203; the source and drain electrodes 206 and 208 being separate from each other on the substrate 201 having semiconductor layer 204; and the passivation (or protection) layer 205 formed on the entire surface of the substrate 201 having the source and drain electrodes 206 and 208. The semiconductor layer 204 includes an active layer formed from amorphous silicon and an ohmic contact layer 204*b* formed from impurity-doped amorphous silicon.

The first dual gate transistor DGT1 includes: the bottom gate electrode 202*a* formed on the substrate 201; the gate insulating film 203 formed, opposite part of the bottom gate electrode 202*a*, on the substrate 201 having the bottom gate electrode 202*a*; the semiconductor layer 204 formed on the substrate 201 along with the gate insulating film 203 and consisting of an active layer 204*a* and an ohmic contact layer 204*b*; the source and drain electrodes 206 and 208 being separate from each other on the substrate 201 having semiconductor layer 204; the passivation (or protection) layer 205 formed on the entire surface of the substrate 201 having the source and drain electrodes 206 and 208; and the top gate electrode 202*b* formed on the substrate 201 with the passivation layer 205 and electrically connected to the bottom gate electrode 202*a* through a contact hole.

Figure 7A:
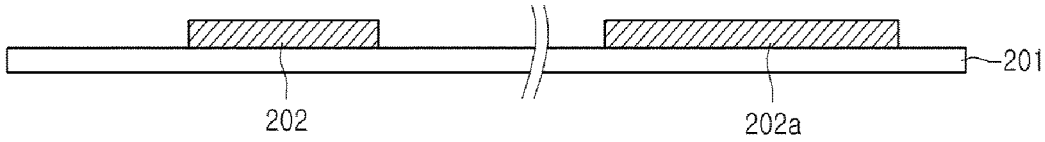
FIGS. 7A and 7E are views explaining the processes of manufacturing the first transistor and the first dual gate transistor of FIG. 6.
Figure 7B:
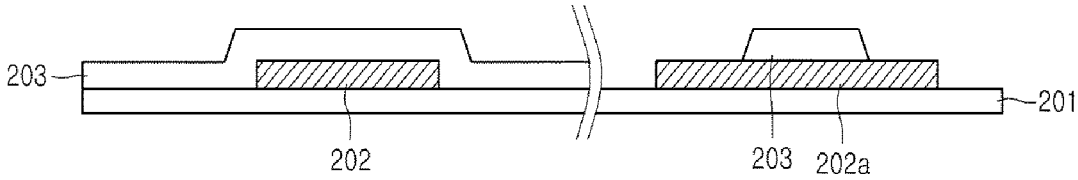
Figure 7C:
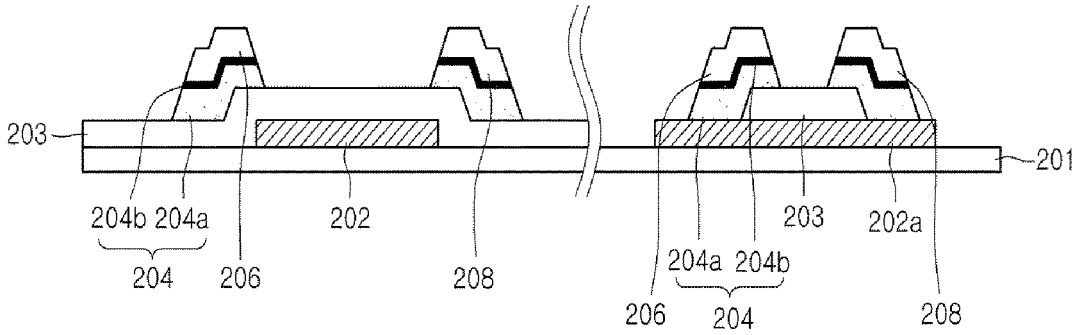
Figure 7D:
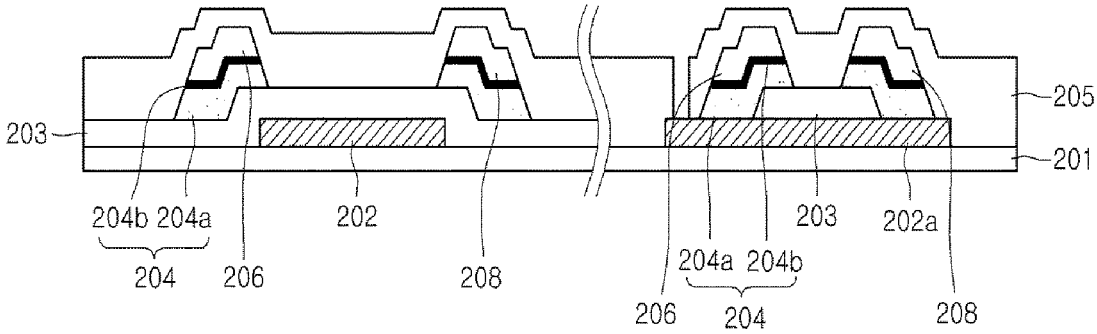
Figure 7E:
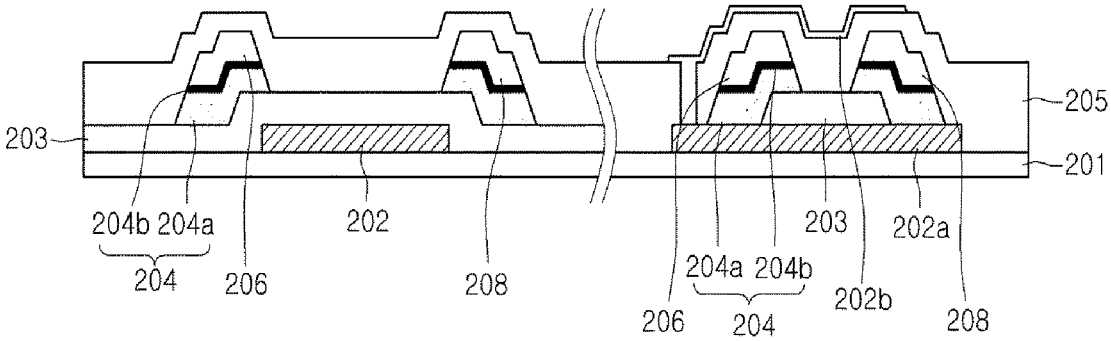

FIGS. 7A and 7E are views explaining a processes of manufacturing the first transistor and the first dual gate transistor of FIG. 6.

As shown in FIG. 7A, the gate electrode 202 of the first transistor T1 and the bottom gate electrode 202*a* of the first dual gate transistor DGT1 are formed on the substrate 201 by depositing one member selected from the conductive metal group including aluminum (Al), aluminum alloy (AlNd), tungsten (W), chrome (Cr), Molybdenum (Mo), and so on, and by patterning the deposited conductive metal film.

Sequentially, the gate insulating film 203 is formed on the substrate 201 with the gate electrode 202 and the bottom gate electrode 202*a* therein, as shown in FIG. 7B. The gate insulating film 203 is provided by depositing one material selected from an inorganic insulation material group including silicon nitride (SiNx), silicon oxide (a-Si:H), and so on. In another way, the gate insulating film 203 can also be formed by depositing one organic insulation material such as benzocyclobutane (BCB), acrylic-based resin, and so on. Also, the gate insulating film 203 formed in the region of the first dual gate transistor DGT1 exists not only on a part of the bottom gate electrode 202*a* but on the entire surface of the substrate 201.

The amorphous silicon (a-Si:H) and the impure amorphous silicon (n+a-Si:H) layers are then sequentially formed on the substrate 201 with the gate insulating film 203 thereon, through the depositing process. The conductive metal film is formed on the substrate 201 with the amorphous silicon layer and the impure amorphous silicon layer thereon, through the depositing process. The amorphous silicon layer, the impure amorphous silicon layer, and the conductive metal film are all sequentially patterned through a masking process, as shown in FIG. 7C.

The patterned amorphous silicon (a-Si:H) layer and the patterned impure silicon (n+a-Si:H) layer are provided as the active layer 204*a* and the ohmic contact layer 204*b*, respectively. The active and ohmic contact layers 204*a* and 204*b* together form the semiconductor layer 204. The patterned conductive metal film is used to keep the source and drain electrodes 206 and 208 apart from each other. The source and drain electrodes 206 and 208 may be formed of one material selected from the conductive metal group including aluminum (Al), aluminum alloy (AlNd), tungsten (W), chrome (Cr), Molybdenum (Mo), and so on.

The passivation (or protection) layer 205 is formed on the entire surface of the substrate 201 including the semiconductor layer 204 and the source and drain electrodes 206 and 208, as shown in FIG. 7D. The passivation layer 205 protects the source and drain electrodes 206 and 208, the ohmic contact layer 204*b*, and the active layer 204*a* from an intrusion of alien substances. Also, a contact hole partially exposing the bottom gate electrode 202*a* is formed on the substrate 201 with the passivation layer 205 thereon. In other words, the contact hole is provided in order to partially expose the bottom gate electrode 202*a*.

Finally, the conductive metal film is formed on the passivation layer 205 including the contact hole. The conductive metal film covers the entire surface of the substrate 201 and is connected to the partially exposed bottom gate electrode 202*a* via the contact hole. The conductive metal film may be formed of the same material as the bottom gate electrode 202*a*.

Such a conductive metal film formed on the entire surface of the substrate 201 is patterned as shown in FIG. 7E. The patterned conductive metal film is positioned only in the region of the first dual gate transistor DGT1. In other words, the patterned conductive metal film is completely removed from the region of the first transistor T1. This patterned conductive metal film is used for the top gate electrode 202*b*.

In this manner, since the top gate electrode 202*b* is electrically connected to the bottom gate electrode 202*a*, the top gate electrode 202*b* of the first dual gate transistor DGT1 responds to a drive signal which is applied to the bottom gate electrode 202*a*, as well. Accordingly, the first dual gate transistor DGT1 with the bottom and top gate electrodes 202*a* and 202*b* has a response time faster than the first transistor T1 with only the gate electrode 202. Also, the first dual gate transistor DGT1 can reduce charging and discharging time, compared to the first transistor T1.

Furthermore, if the dual gate transistor DGT with the bottom and top gate electrodes electrically connected to each other is included in the output portion of the shift register ST, the shift register ST may rapidly apply the output signal to the gate line GL, in comparison with the shift register ST which includes the related art transistor T. As such, the thin film transistor connected to the gate line GL in the pixel region is rapidly turned-on/off, thereby improving the response time of the liquid crystal.

Figure 8:
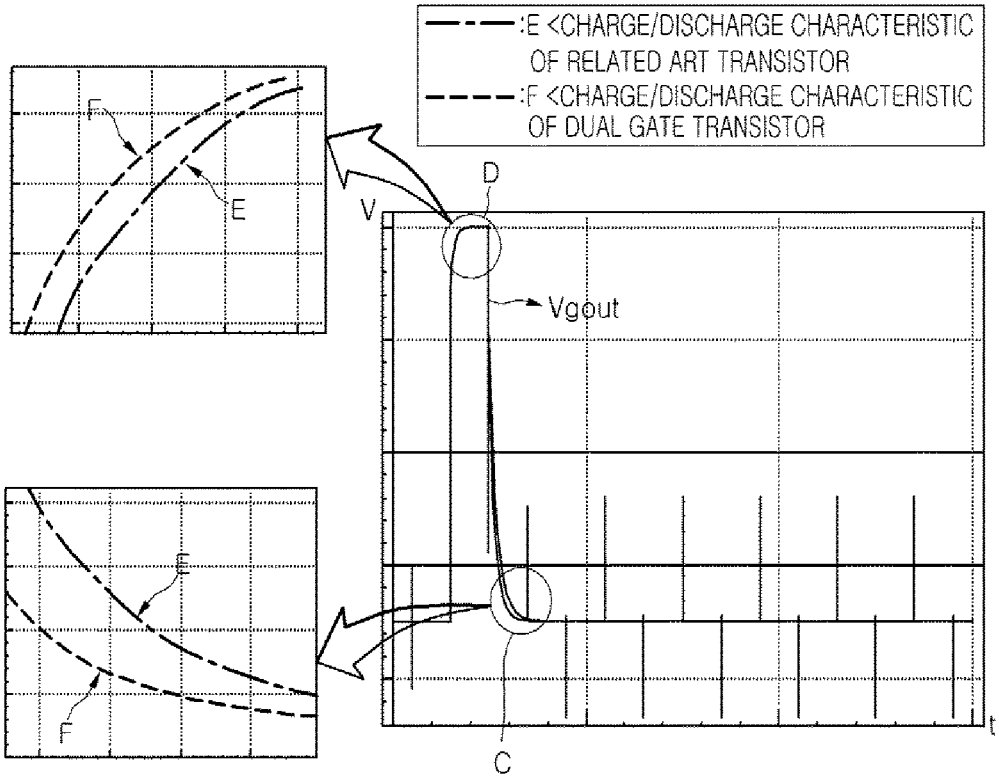
FIG. 8 is a graphic diagram comparison showing the charging/discharging times of normal and dual gate transistors.

FIG. 8 is a graphic diagram comparison showing the charging/discharging times of normal and dual gate transistors.

Referring to FIG. 8, the shift register ST having the dual gate transistor DGT reduces the charging time by about 0.54 μs in comparison with the shift register having the related art transistor T, with regards to the rising edge of the output signal Vgout which is applied to the gate line GL. Also, the shift register ST with the dual gate transistor DGT reduces the discharging time by about 3.34 μs in comparison with the shift register ST, in the falling edge of the output signal Vgout.

Although the response characteristics shown in FIG. 8 are experimental data, it is evident that the shift register ST with the dual gate transistor DGT having the top and bottom gate electrodes connected to each other charges and discharges the output signal faster than the shift register with the related art transistor T.

Therefore, if the dual gate transistor DGT with the bottom and top gate electrodes electrically connected to each other is included in the output portion of the shift register ST, the shift register ST may rapidly apply the output signal to the gate line GL in comparison with the shift register ST which includes the related art transistor T. As such, the thin film transistor connected to the gate line GL in the pixel region is also rapidly turned-on/off, thereby improving the response time of the liquid crystal.

As described above, the LCD device forces the scan signal output portion to include the dual gate transistor so that the scan signal output portion is rapidly driven. Therefore, the transistor reduces its charging/discharging time. As a result, the response time of the liquid crystal can be improved.

It will be apparent to those skilled in the art that various modifications and variations can be made in the present disclosure. Thus, it is intended that the present disclosure cover the modifications and variations of this embodiment provided they come within the scope of the appended claims and their equivalents.

What is claimed is:

1. A liquid crystal display device comprising:

a display panel displaying an image and including a plurality of gate lines and a plurality of data lines arranged thereon;

a data driver supplying the data lines of the display panel with data signals corresponding to the image; and a gate driver formed on the display panel and having a plurality of shift registers sequentially shifting a start pulse to be applied to the gate lines, each of the shift registers including an output portion with first and second dual gate transistors, wherein the first dual gate transistor includes: first and second gate electrodes responsive to a voltage on a first node, a source electrode receiving a clock signal, and a drain electrode connected to the respective gate line applying the clock signal from the source electrode to the respective gate line according to the voltage on the first node, and the second dual gate transistor includes: first and second gate electrodes responsive to a voltage on a second node, a drain electrode receiving a first source voltage, and a source electrode applying the first source voltage on the drain electrode to the respective gate line according to the voltage on the second node; and a control portion controlling the voltages on the first and second nodes.

2. The liquid crystal display device claimed as claim 1, wherein the first and second gate electrodes of the first dual gate transistor are electrically connected to each other, and the first and second gate electrodes of the second dual gate transistor are electrically connected to each other.

3. The liquid crystal display device claimed as claim 1, wherein the first and second dual gate transistors each include:

the first gate electrode formed on a substrate;

a gate insulating film formed on the substrate with the first gate electrode;

a semiconductor layer formed, opposite the first gate electrode, on the substrate with the gate insulating film;

the source and drain electrodes being separate from each other on the semiconductor layer;

a passivation layer formed on the source and drain electrodes; and the second gate electrode formed, opposite the semiconductor layer, on the passivation layer and electrically connected to the first gate electrode through a contact hole on the passivation layer.

4. The liquid crystal display device claimed as claim 3, wherein the second gate electrode is formed of the same conductive metal as the first gate electrode.

5. The liquid crystal display device claimed as claim 1, wherein the first dual gate transistor responds to the voltage on the first node and selectively charges the output signal in the respective gate line.

6. The liquid crystal display device claimed as claim 1, wherein the second dual gate transistor responds to the voltage on the second node and selectively discharges the output signal in the respective gate line.

* * * * *